US007713087B2

(12) United States Patent
Kabasawa et al.

(10) Patent No.: US 7,713,087 B2
(45) Date of Patent: May 11, 2010

(54) TERMINAL STRUCTURE AND VACUUM PUMP

(75) Inventors: Takashi Kabasawa, Yachiyo (JP); Satoshi Okudera, Yachiyo (JP); Yoshiyuki Sakaguchi, Yachiyo (JP)

(73) Assignee: Edwards Japan Limited (JP)

( * ) Notice: Subject to any disclaimer, the term of this patent is extended or adjusted under 35 U.S.C. 154(b) by 0 days.

(21) Appl. No.: 12/217,267

(22) Filed: Jul. 1, 2008

(65) Prior Publication Data

US 2008/0274634 A1 Nov. 6, 2008

Related U.S. Application Data

(62) Division of application No. 11/448,196, filed on Jun. 7, 2006, now Pat. No. 7,393,228.

(30) Foreign Application Priority Data

Jun. 9, 2005 (JP) ..... 2005-169336

(51) Int. Cl.
*H01R 13/58* (2006.01)

(52) U.S. Cl. ..... 439/606; 439/581; 439/874

(58) Field of Classification Search ..... 439/581, 439/604, 606, 722, 874
See application file for complete search history.

(56) References Cited

U.S. PATENT DOCUMENTS

| | | | | | |
|---|---|---|---|---|---|
| 3,007,130 | A * | 10/1961 | Martin | 439/736 |
| 3,678,444 | A * | 7/1972 | Stevens et al. | 439/551 |
| 5,035,637 | A * | 7/1991 | Mathews et al. | 439/271 |
| 5,879,176 | A * | 3/1999 | Stimson | 439/188 |
| 6,290,457 | B1 * | 9/2001 | Kabasawa et al. | 415/90 |
| 6,348,749 | B1 * | 2/2002 | Ueyama | 310/90.5 |
| 6,971,349 | B2 * | 12/2005 | Burch et al. | 123/90.16 |
| 7,379,023 | B2 * | 5/2008 | Yamanaka et al. | 343/700 MS |
| 7,393,228 | B2 * | 7/2008 | Kabasawa et al. | 439/247 |
| 2006/0281352 | A1 * | 12/2006 | Kabasawa et al. | 439/247 |
| 2007/0001910 | A1 * | 1/2007 | Yamanaka et al. | 343/700 MS |
| 2008/0274634 | A1 * | 11/2008 | Kabasawa et al. | 439/247 |

* cited by examiner

*Primary Examiner*—James Harvey
(74) *Attorney, Agent, or Firm*—Adams & Wilks

(57) ABSTRACT

A vacuum pump casing has an opening that is covered and sealed by a cover member. The cover member is formed of molded resin with connector pins molded therein. The connector pins project outwardly from opposite sides of the cover member and are connected outside the pump casing to cables leading to a control device and connected inside the pump casing to cables leading to components within the pump casing.

8 Claims, 9 Drawing Sheets

TERMINAL STRUCTURE AND VACUUM PUMP

CROSS REFERENCE TO RELATED APPLICATION

The present application is a division of application Ser. No. 11/448,196, filed Jun. 7, 2006 and now U.S. Pat. No. 7,393, 228, and priority thereto for common subject matter is hereby claimed.

BACKGROUND OF THE INVENTION

1. Field of the Invention

The present invention relates to a terminal structure and a vacuum pump, and in particular, to a terminal structure capable of preventing damage due to an excessive force and having high sealing property, and a vacuum pump to which the terminal structure is applied.

2. Description of the Related Art

As a result of recent developments in electronics, there is a rapidly increasing demand for semiconductor devices such as memories and integrated circuits.

Such semiconductor devices are manufactured by doping semiconductor substrates of a very high purity with impurities to impart electrical properties thereto, by forming minute circuits on the semiconductor substrates through etching, etc.

In order to avoid the influences of dust in the air, etc., such operations must be conducted in a chamber in a high vacuum state. To evacuate this chamber, a vacuum pump is generally used; in particular, a turbo molecular pump, which is a kind of vacuum pump, is widely used since it allows maintenance with ease, etc.

Further, a semiconductor manufacturing process involves a number of steps of causing various process gasses to act on a semiconductor substrate, and the turbo molecular pump is used not only to create a vacuum in the chamber but also to evacuate such process gases from the chamber.

Further, in an equipment such as an electron microscope, a turbo molecular pump is used to create a high vacuum state within the chamber of the electron microscope, etc. in order to prevent refraction, etc. of the electron beam due to the presence of dust or the like.

Further, such a turbo molecular pump is composed of a turbo molecular pump main body for sucking gas from the chamber of a semiconductor manufacturing apparatus, the electron microscope, or the like, and a control device for controlling the turbo molecular pump main body.

FIG. 5 shows a longitudinal sectional view of the turbo molecular pump main body.

In FIG. 5, a turbo molecular pump main body 100 has an inlet port 101 formed at the upper end of an outer cylinder 127. On an inner side of the outer cylinder 127, there is provided a rotor 103 in a periphery of which there are formed radially and in a number of stages a plurality of rotary vanes 102*a*, 102*b*, 102*c*, . . . formed of turbine blades for sucking and evacuating gases.

Mounted at a center of this rotor 103 is a rotor shaft 113, which is levitatingly supported and position-controlled by, for example, a so-called 5-axis control magnetic bearing.

Upper radial electromagnets 104 are four electromagnets arranged in pairs in an X-axis and an Y-axis. In close proximity to and in correspondence with the upper radial electromagnets 104, there are provided four upper radial sensors 107. The upper radial sensors 107 detect radial displacement of the rotor 103, and transmit displacement signals to a control device 200.

Based on the displacement signals detected by the upper radial sensors 107, the control device 200 controls the excitation of the upper radial electromagnets 104 by an output of an amplifier transmitted through a magnetic bearing control circuit having a PID adjustment function, and adjusts the radial position of an upper side of the rotor shaft 113. Here, the magnetic bearing control circuit converts analog sensor signals representing the displacement of the rotor shaft 113 detected by the upper radial sensors 107 into digital signals by an A/D converter, and processes the signals to adjust electric current caused to flow through the upper radial electromagnets 104, levitating the rotor shaft 113.

Further, to perform fine adjustment on the electric current caused to flow through the upper radial electromagnets 104, the electric current caused to flow through the upper radial electromagnets 104 is measured, and fed back to the magnetic bearing control circuit.

The rotor shaft 113 is formed of a high magnetic permeability material (such as iron), and is attracted by the magnetic force of the upper radial electromagnets 104. Such adjustment is effected independently in the X-axis and the Y-axis directions.

Further, lower radial electromagnets 105 and lower radial sensors 108 are arranged in the same way as the upper radial electromagnets 104 and the upper radial sensors 107, and the lower radial position of the of the rotor shaft 113 is adjusted by the control device 200 in the same manner as the upper radial position thereof.

Further, axial electromagnets 106A and 106B are arranged so as to sandwich from above and below a circular metal disc 111 provided in a lower portion of the rotor shaft 113. The metal disc 111 is formed of a high magnetic-permeability material, such as iron. There are provided axial sensors 109 for detecting an axial displacement of the rotor shaft 113. Axial displacement signals obtained through detection by the axial sensors 109 are transmitted to the control device 200.

Based on the axial displacement signals, the axial electromagnets 106A and 106B are excited and controlled by the output of the amplifier transmitted through the magnetic bearing control circuit with a PID adjustment function of the control device 200. The axial electromagnets 106A attract the metal disc 111 upwards by the magnetic force, and the axial electromagnets 106B attract the metal disc 111 downwards.

In this way, the control device 200 appropriately adjusts the magnetic forces exerted on the metal disc 111 by the axial electromagnets 106A and 106B, and magnetically levitates the rotor shaft 113 in the axial direction, retaining it in the air in a non-contact fashion.

A motor 121 is equipped with a plurality of magnetic poles circumferentially arranged so as to surround the rotor shaft 113. Each of these magnetic poles is controlled so as to rotate and drive the motor 121 by a power signal output from a drive circuit and transmitted through a motor control circuit with a PWM control function of the control device 200.

Further, the motor 121 is equipped with an RPM sensor and a motor temperature detecting sensor (not shown). The RPM of the rotor shaft 113 is controlled by the control device 200 on the basis of detection signals received from the RPM sensor and the motor temperature detecting sensor.

There are arranged a plurality of stationary vanes 123*a*, 123*b*, 123*c*, . . . , with a slight gap being between them and the rotary vanes 102*a*, 102*b*, 102*c*, . . . , respectively. In order to downwardly transfer the molecules of the exhaust gas through collision, the rotary vanes 102*a*, 102*b*, 102*c*, . . . are inclined by a predetermined angle with respect to planes perpendicular to the axis of the rotor shaft 113.

Further, the stationary vanes 123 are inclined by a predetermined angle with respect to planes perpendicular to the axis of the rotor shaft 113, and are arranged so as to protrude toward the interior of the outer cylinder 127 and in alternate stages with the rotary vanes 102.

Further, one ends of the stationary vanes 123 are supported while being inserted between a plurality of stationary vane spacers 125*a*, 125*b*, 125*c*, . . . stacked together.

The stationary vane spacers 125 are ring-like members formed of a metal, such as aluminum, iron, stainless steel, or copper, or a metal such as an alloy containing those metals as the components.

Further, in an outer periphery of the stationary vane spacers 125, the outer cylinder 127 is fixed in position with a slight gap therebetween. A base portion 129 is provided at a bottom portion of the outer cylinder 127. Between the lower portion of the stationary vanes pacers 125 and the base portion 129, there is provided a threaded spacer 131. In the portion of the base portion 129 which is below the threaded spacer 131, there is formed an exhaust port 133, which communicates with the exterior.

The threaded spacer 131 is a cylindrical member formed of a metal, such as aluminum, copper, stainless steel, or iron, or a metal such as an alloy containing those metals as the components, and has in an inner peripheral surface thereof a plurality of spiral thread grooves 131*a* formed.

The spiral direction of the thread grooves 131*a* is a direction in which, when the molecules of the exhaust gas move in the rotating direction of the rotor 103, these molecules are transferred toward the exhaust port 133.

In the lowermost portion of the rotor 103 connected to the rotary vanes 102*a*, 102*b*, 102*c*, . . . , there is provided a rotary vane 102*d* vertically downwards. The rotary vane 102*d* has an outer peripheral surface of a cylindrical shape, protrudes toward the inner peripheral surface of the threaded spacer 131, and is placed in close proximity to the threaded spacer 131 with a predetermined gap therebetween.

Further, the base portion 129 is a disc-like member constituting a base portion of the turbo molecular pump main body 100, and is generally formed of a metal, such as iron, aluminum, or stainless steel.

The base portion 129 physically retains the turbo molecular pump main body 100, and also functions as a heat conduction path, so it is desirable to use a metal that is rigid and of high heat conductivity, such as iron, aluminum, or copper, for the base portion 129.

Further, a connector 160 is arranged on the base portion 129. The connector 160 serves as an outlet for signal lines between the turbo molecular pump main body 100 and the control device 200. The turbo molecular pump main body 100 side portion of the connector 160 is formed as a male terminal and the control device 200 side portion thereof is formed as a female terminal. Further, the connector 160 has a seal structure, which is detachable, and capable of maintaining a vacuum inside the turbo molecular pump main body 100.

When, with this construction, the rotary vanes 102 are driven by the motor 121 and rotate together with the rotor shaft 113, an exhaust gas is sucked from a chamber through the inlet port 101 by the action of the rotary vanes 102 and the stationary vanes 123.

Then, the exhaust gas sucked in through the inlet port 101 flows between the rotary vanes 102 and the stationary vanes 123 to be transferred to the base portion 129. The exhaust gas transferred to the base portion 129 is sent to the exhaust port 133 while being guided by the thread grooves 131*a* of the threaded spacer 131.

In the above-described example, the threaded spacer 131 is provided in the outer periphery of the rotary vane 102*d*, and the thread grooves 131*a* are formed in the inner peripheral surface of the threaded spacer 131. However, conversely to the above, the thread grooves may be formed in the outer peripheral surface of the rotary vane 102*d*, and a spacer with a cylindrical inner peripheral surface may be arranged in the periphery thereof.

Further, in order that the gas sucked in through the inlet port 101 may not enter the electrical section formed of the motor 121, the lower radial electromagnets 105, the lower radial sensors 108, the upper radial electromagnets 104, the upper radial sensors 107, etc., a predetermined pressure is maintained with a purge gas.

For this purpose, piping (not shown) is arranged in the base portion 129, and the purge gas is introduced through the piping. The purge gas thus introduced flows through the gaps between a protective bearing 120 and the rotor shaft 113, between a rotor and stator of the motor 121, and between a stator column 122 and the rotary vanes 102 before being transmitted to the exhaust port 133.

While the turbo molecular pump main body 100 and the control device 200 are usually formed as separate components, they are, in some cases, integrated with each other for a space saving as shown in JP 10-103288 A and JP 11-173293 A.

FIG. 6 shows an example in which the turbo molecular pump main body 100 and the control device 200 are not separated but integrated with each other. In this case, cables 161 are attached to the connector 160 on the turbo molecular pump main body 100 side. A connector 260 is arranged at the other end of the cables 161 so as to be detachable with respect to the control device 200. The connector 160 and the connector 260 respectively protrude from the side portion of the turbo molecular pump main body 100 and the control device 200, with the cables in a bundle extending between the connectors.

In a 5-axis control magnetic bearing, the number of cables is 30 or more, so a large size vacuum connector is required. The cables are thick, and their bending radius is large. However, they are flexible to a certain degree, so they are not easily damaged or the like by an excessive force applied at the time of assembly. On the other hand, they involve a problem in terms of space.

In another example of the arrangement in which the turbo molecular pump main body and the control device are integrated with each other, instead of exposing the cables outside the turbo molecular pump main body 100 and the control device 200 as shown in FIG. 6, it is possible, as shown in FIG. 7, to directly connect a male connector 165 protruding from a turbo molecular pump main body 110 with a female connector 265 protruding from a control device 210.

In this connection, the male connector 165 is a vacuum connector, and is fastened to the turbo molecular pump main body 110 by bolts 167. The female connector 265 is similarly fastened to the control device 210 by bolts 169. Further, a plurality of spacers 171 are provided between the turbo molecular pump main body 110 and the control device 210. The spacers 171 are formed as hollow cylinders, and bolts 173 are passed through them so as to fix the turbo molecular pump main body 110 and the control device 210 to each other through the intermediation of the spacers 171.

In this way, the male connector 165 is fastened to the turbo molecular pump main body 110 by the bolts, and the female connector 265 is fastened to the control device 210 by the bolts, so, when, for example, the control device 210 is inserted obliquely to attach it to the turbo molecular pump main body 110, an excessive force may be exerted between the male connector 165 and the female connector 265, resulting in damage of the connectors.

SUMMARY OF THE INVENTION

The present invention has been made in view of the above problems in the prior art. It is an object of the present invention to provide a terminal structure capable of preventing damage due to an excessive force and having high sealing property, and a vacuum pump to which the terminal structure is applied.

Therefore, a terminal structure of the present invention is constructed by including: a first connector; a first member having the first connector; a second connector electrically connected by being fit-engaged with the first connector; a second member having the second connector; and elastic retaining means for elastically retaining the first connector with respect to the first member, and/or elastically retaining the second connector with respect to the second member.

Even when the first connector is inserted somewhat obliquely with respect to the second connector, and an excessive force is exerted between the connectors, it is possible to mitigate the force through the elastic force of the elastic retaining means. Thus, there is no fear of the connectors suffering damage. Further, there is little fear of an electrical short-circuiting, a leakage of current, etc.

Further, the terminal structure of the present invention is constructed by including movement regulating means for effecting regulation to prevent a distance through which the fit-engagement is effected from exceeding a predetermined length.

Due to this regulation, the tension of the elastic force due to the elastic retaining means is maintained at an appropriate level. Thus, it is possible to obtain an appropriate rigidity at the time of fit-engagement and to reliably maintain the connection between the pins.

Further, the present invention relates to a vacuum pump, characterized in that the first member is applied to a vacuum pump main body, and the second member is applied to a control device.

It is desirable for the vacuum pump main body and the control device to be integrated with each other. Even when the control device is inserted somewhat obliquely with respect to the vacuum pump main body, and an excessive force is exerted between the connectors, it is possible to mitigate the force by the elastic retaining means, so there is no fear of the connectors suffering damage. Thus, there is little fear of a gas leakage occurring from the vacuum pump main body to cause a pump heating, an electrical short-circuiting, a leakage of current, etc., thereby achieving an improvement in terms of the reliability of the pump.

Still further, the vacuum pump of the present invention is constructed by including: at least one cable whose conductor is exposed at a portion between both ends of the cable; a molding member formed through solidification-molding with at least the exposed conductor portion of the cable included; and an outer cylinder to or with which the molding member is mounted or integrated.

It is desirable for the vacuum pump main body and the control device to be integrated with each other. The cable is molded with a resin or the like with the conductor exposed, so it is possible to prevent the gas leakage through a gap between the conductor and the cable covering. Thus, it is possible to effect a vacuum seal without using a large vacuum connector. Further, it is possible to realize a space saving and a reduction in cost. The pump and the control circuit are connected to each other by the cable, so even if an excessive force is applied, the cable simply deflects, and there is no fear of the connectors suffering damage. Thus, there is little fear of a gas leakage occurring from the vacuum pump main body to cause a pump heating, an electrical short-circuiting, a leakage of current, etc., thereby achieving an improvement in terms of the reliability of the pump.

Yet further, the vacuum pump of the present invention is constructed by including: at least one pin with conductivity; cable conductor fixing means arranged at both ends of the pin and allowing conductors of cables fixed to the pin; a molding member formed through solidification-molding with the pin included; and an outer cylinder to or with which the molding member is mounted or integrated.

It is desirable for the vacuum pump main body and the control device to be integrated with each other. A molding member composed of a resin or the like is solidification-molded with the pin included. Thus, there is no gap between the molding member and the pin, maintaining a vacuum seal therebetween. When the molding member is mounted to the outer cylinder, it is desirable to arrange a seal member, such as an O-ring, between the molding member and the outer cylinder. With this arrangement, it is possible to effect a vacuum seal without using a large vacuum connector, and it is possible to realize a space saving and a reduction in cost.

The cable conductor fixing means may be soldered, press-fitted, etc. after forming elongated holes at both ends of the pin and passing the cable cores therethrough. Thus, the operation involved is simple. The pump and the control circuit are connected to each other by the cable, so even if an excessive force is applied, the cable simply deflects, and there is no fear of the connector suffering damage. Thus, there is little fear of an electrical short-circuiting, a leakage of current, etc., thereby achieving an improvement in terms of the reliability of the pump. An end portion of the cable entering the control device can be connected to a miniature terminal or directly connected to the board, etc., whereby a space saving is achieved, and the mounting is easy to perform.

Further, the vacuum pump of the present invention is characterized in that: a control device is provided side by side with the outer cylinder; a cable inside the outer cylinder and a cable inside the control device are electrically connected through the molding member; and the solidification-molded portion of the molding member and at least one of the portion of the molding member mounted to the outer cylinder, and the portion of the molding member integrated with the outer cylinder, are formed as seals.

By arranging the outer cylinder and the control device side by side, the apparatus as a whole is made compact.

DETAILED DESCRIPTION OF THE PREFERRED EMBODIMENTS

Figure 1:
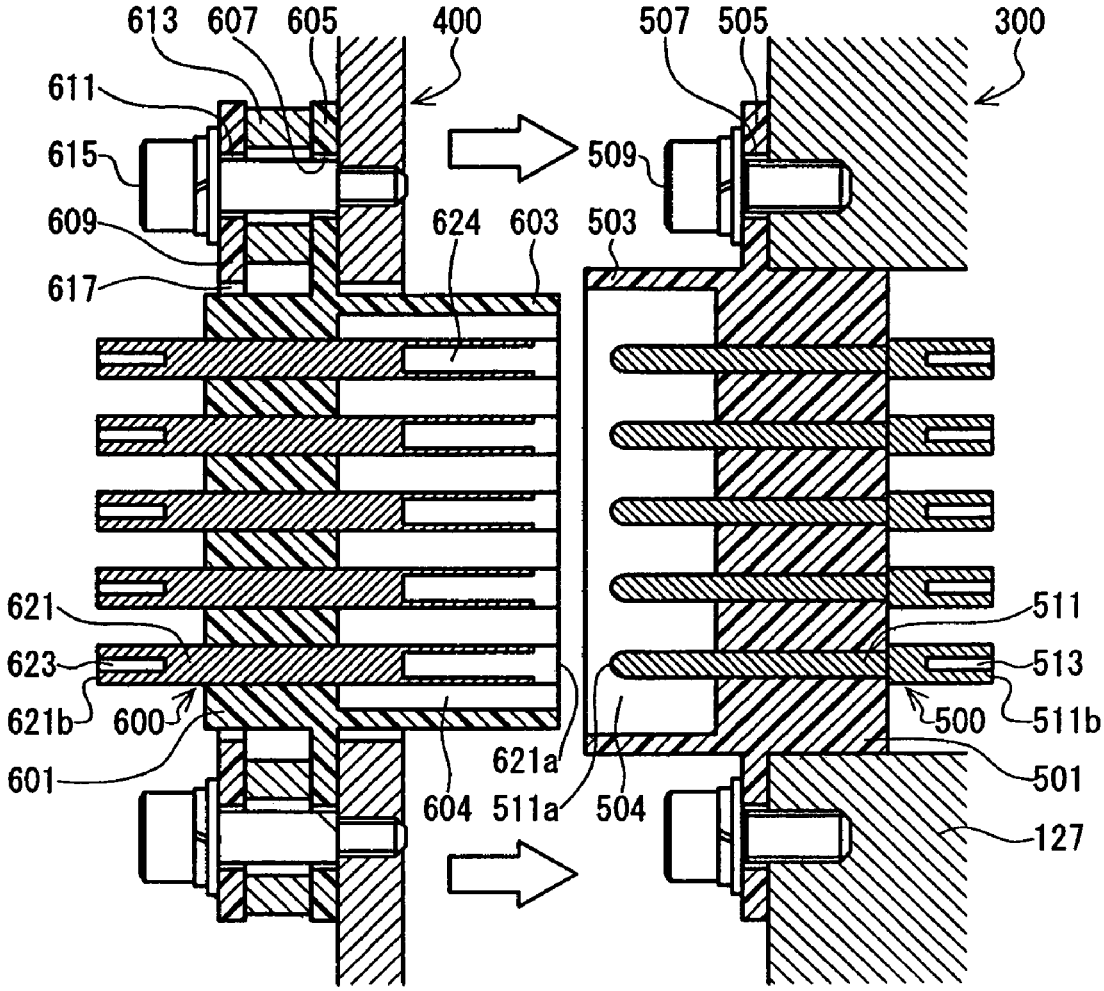
FIG. 1 is a schematic view of a terminal structure according to a first embodiment of the present invention.

In the following, embodiments of the present invention will be described. FIG. 1 is a schematic view of a terminal structure according to a first embodiment of the present invention. In FIG. 1, a male connector 500 and a female connector 600 are arranged on a turbo molecular pump main body 300 side and a control device 400 side, respectively.

The male connector 500 has a tubular portion in the form of a cylindrical wall 503 protruding in a cylindrical fashion toward the control device 400 side from an outer peripheral edge of a thick bottom portion 501, and, inside the male connector 500, there is formed a columnar cavity 504 surrounded by the cylindrical wall 503 and the bottom portion 501. Further, a disc-like flange portion 505 is arranged around the bottom portion 501. In the flange portion 505, there are formed a plurality of through-holes 507, through which bolts 509 are passed to be inserted into and fixed to an outer cylinder 127 of the turbo molecular pump main body 300.

Forty-one male connector pins 511 are passed through and fixed to the bottom portion 501 while arranged at equal intervals. A head portion 511*a* at one end of each male pin 511 is formed in a semi-spherical configuration, and an elongated hole 513 is formed at another end portion 511*b* so as to allow soldering after passing a cable core (not shown). The bottom portion 501 is formed of a resin, and a sufficient sealing property is secured between it and the male pins 511.

The female connector 600 arranged on the control device 400 side has a tubular portion in the form of a cylindrical wall 603 protruding in a cylindrical fashion toward the turbo molecular pump main body 300 side from an outer peripheral edge of a thick bottom portion 601, and, in side the female connector 600, there is formed a columnar cavity 604 surrounded by the cylindrical wall 603 and the bottom portion 601. Further, a disc-like flange portion 605 is arranged around the bottom portion 601. A plurality of through-holes 607 are provided in the flange portion 605.

Further, a flat annular plate 609 is arranged so as to be opposed to the flange portion 605. The flat plate 609 has through-holes 611 at positions opposed to the through-holes 607 of the flange portion 605. Female screws are cut in the inner side of the through-holes 611. At a center of the flat plate 609, there is formed a circular hole 617, through which the bottom portion 601 can pass. Elastically deformable members comprised of elastic and hollow waved washers 613 are arranged around the through-holes 607 and the through-holes 611 between the flange portion 605 and the flat plate 609. Bolts 615 are passed through the through-holes 607, the through-holes 611, and the waved washers 613 to be fastened to a casing wall of the control device 400. As shown in FIG. 1, small gaps are provided between the through-holes 607 and the bolts 615.

Like the male pins 511 of the male connector 500, forty-one female connector pins 621 are passed through and fixed to the bottom portion 601 while arranged at equal intervals. In a head portion 621*a* at one end of each female pin 621, there is formed a pin insertion elongated hole 624, into which the semi-spherical head portion 511*a* at one end of each male pin 511 is to be inserted. In another end portion 621*b* of each female pin, there is formed an elongated hole 623 so as to allow soldering after passing a cable core (not shown). A space defined by the cavity 604 and the female pins 621 is filled with a resin.

Figure 2:
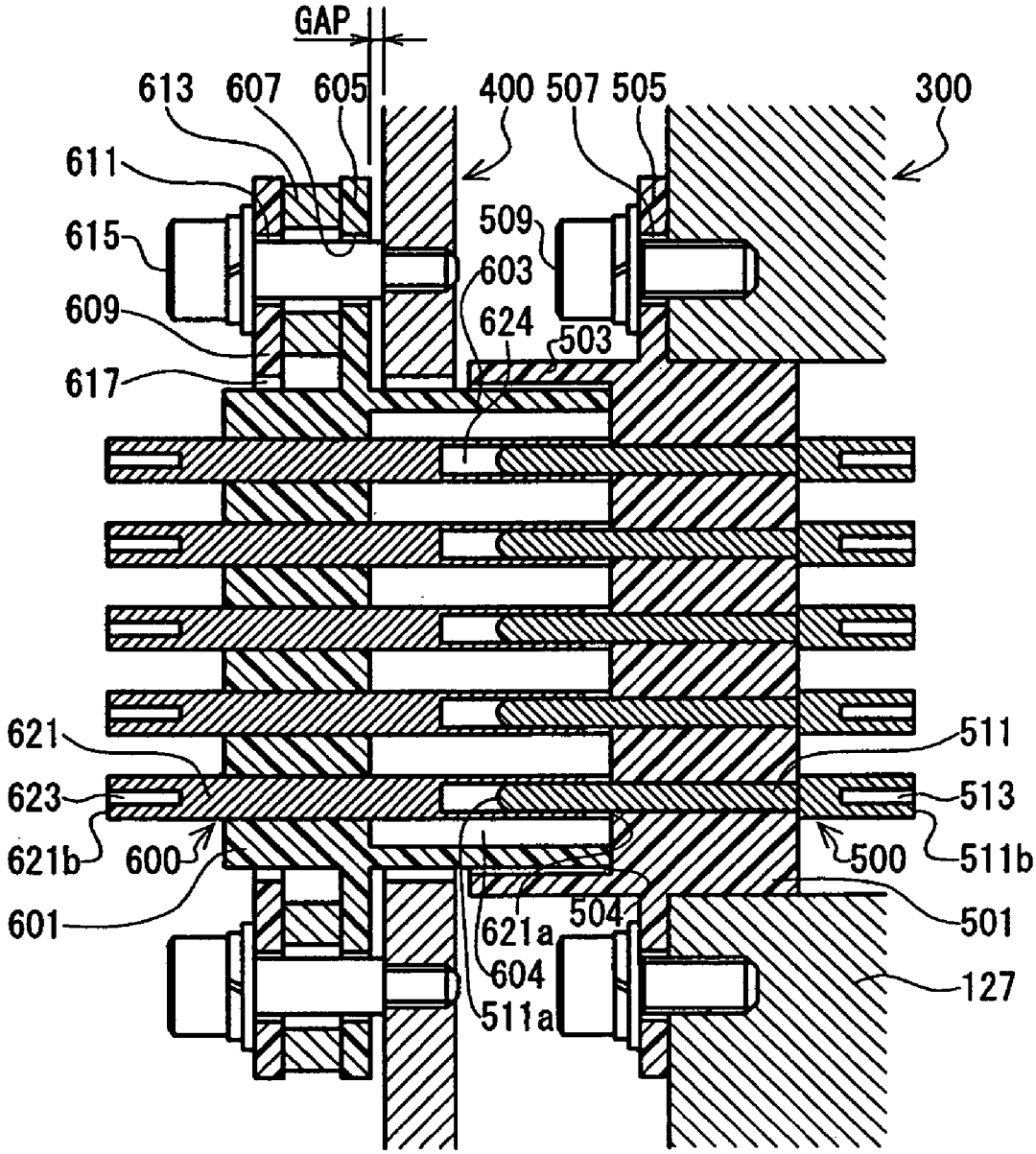
FIG. 2 is a diagram showing a state in which connectors are connected with each other.

With this construction, the control device 400 of FIG. 1 is moved, and the female connector 600 of the control device 400 is connected to the male connector 500 arranged in the turbo molecular pump main body 300. FIG. 1 shows a state prior to the connection of the connectors, and FIG. 2 shows a state after the connection of the connectors. When the control device 400 undergoes transition from the state of FIG. 1 to that of FIG. 2, the cylindrical wall 603 of the female connector 600 is fit-engaged with the cavity 504 of the male connector 500, and, as the connection progresses, the head portions 511*a* at one ends of the male pins 511 are progressively slidably inserted into the pin insertion elongated holes 624.

When, after that, the forward end of the cylindrical wall 603 of the female connector 600 abuts the bottom portion 501 of the male connector 500, the female connector 600 on the control device 400 side, which is of low rigidity, is pushed back against the elastic force of the waved washers 613. At this time, there has been generated a gap of approximately 1 mm between the flange portion 605 of the female connector 600 and the casing wall of the control device 400. As a result, there is generated tension of the elastic force in the waved washers 613, thereby making it possible to obtain an appropriate rigidity at the time of fit-engagement and to reliably maintain the connection between the pins.

With this construction, even when the control device 400 is inserted somewhat obliquely with respect to the turbo molecular pump main body 300, and an excessive force is applied to the female connector 600 and the male connector 500, the force can be mitigated through deformation of the waved washers 613, so there is no fear of the connectors suffering damage. Thus, there is little fear of a gas leakage from the turbo molecular pump main body 300 to cause a pump heating, an electrical short-circuiting, a leakage of current, etc., thereby achieving an improvement in terms of the reliability of the pump.

Figure 8:
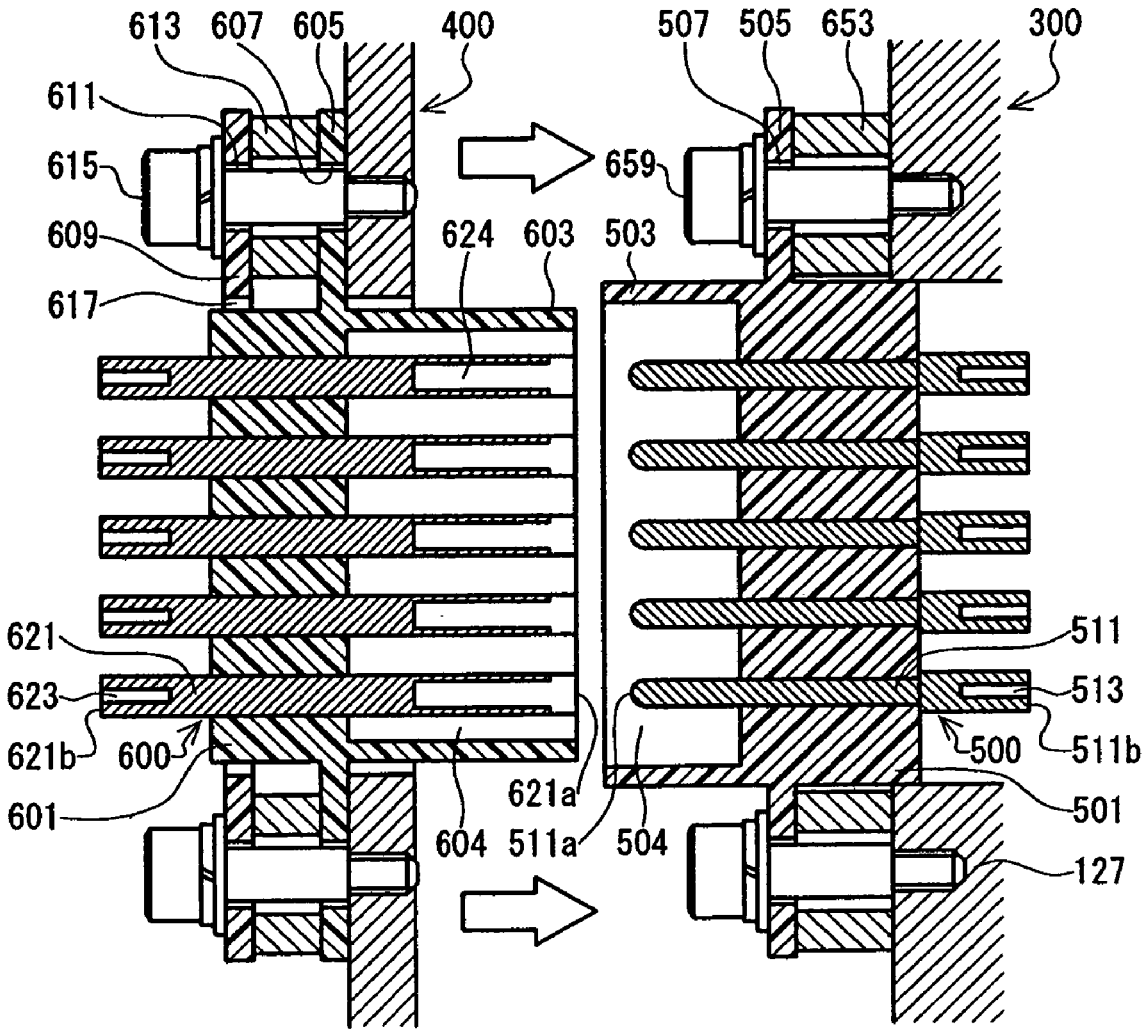
FIG. 8 is a schematic view of another example of a terminal structure according to the first embodiment of the present invention.
Figure 9:
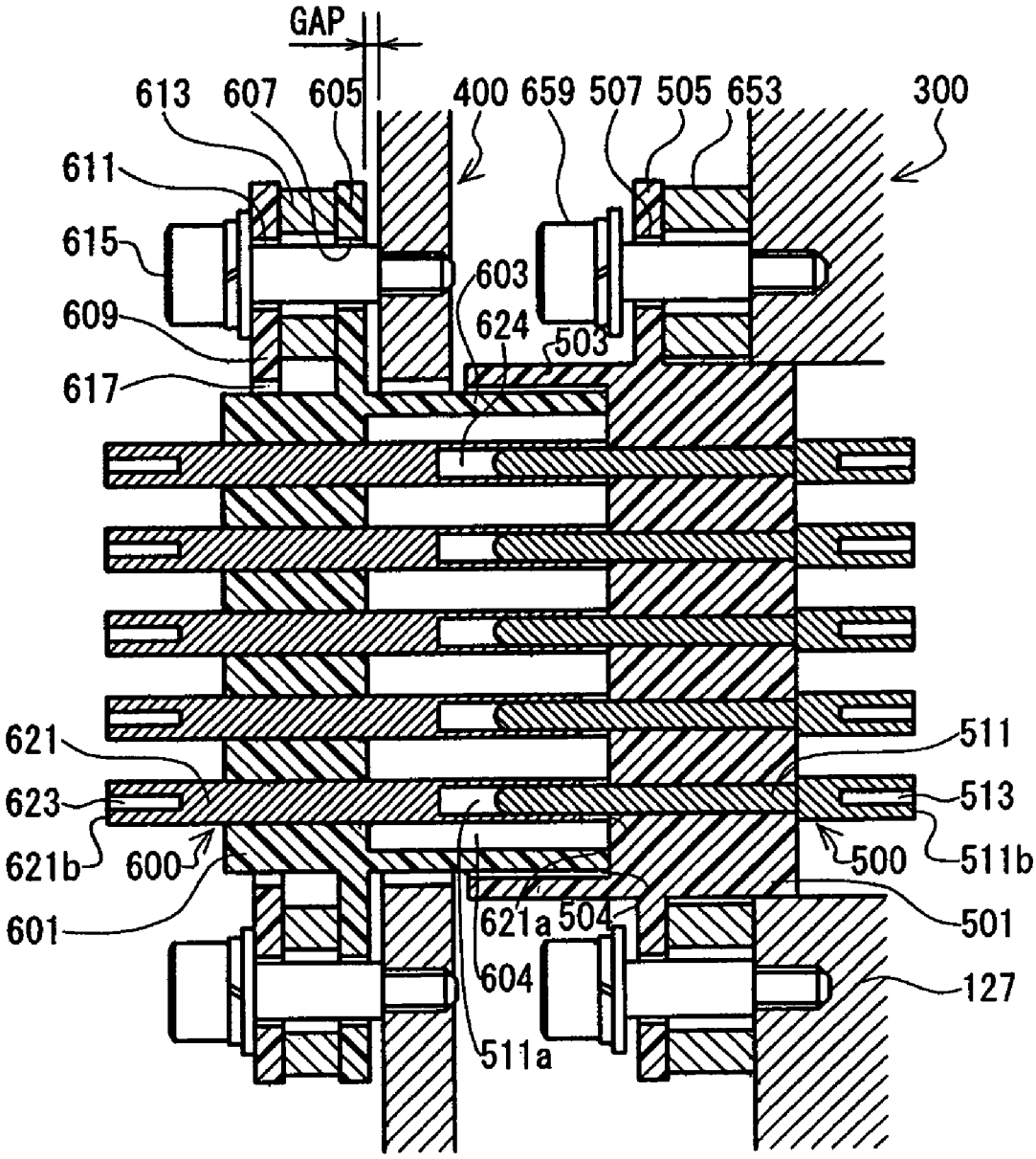
FIG. 9 is a diagram showing a state in which connectors are connected with each other in the other example.

Another example of this embodiment will be described with reference to FIGS. 8 and 9. FIG. 8 is a schematic view of another terminal structure showing a state prior to the connection of the connectors, and FIG. 9 shows a state after the connection of the connectors.

While in the example of FIGS. 1 and 2 the bolts 509 are passed through the through-holes 507, and fixed to the outer cylinder 127 of the turbo molecular pump main body 300, in this example, a plurality of elastic members in the form of waved washers 653 are arranged between the flange portion 505 and the outer cylinder 127, and bolts 659 are passed through the waved washers 653. Male screws are formed in forward end portions of the bolts 659, whereas no screws are formed in middle portions thereof as in the case of the bolts 615.

Thus, when the forward end of the cylindrical wall 603 of the female connector 600 abuts the bottom portion 501 of the male connector 500, the female connector 600 and the male connector 500 are pushed back against the elastic force of the waved washers 613 and the waved washers 653. As a result, there is generated tension of the elastic force in the waved washers 613 and the waved washers 653, thereby making it possible to obtain an appropriate rigidity at the time of fit-engagement and to reliably maintain the connection between the pins.

The outer cylinder 127 corresponds to a first member, and the casing wall of the control device 400 corresponds to a second member. The present invention is applicable not only to a turbo molecular pump, but also to a general connector connection structure.

Figure 3:
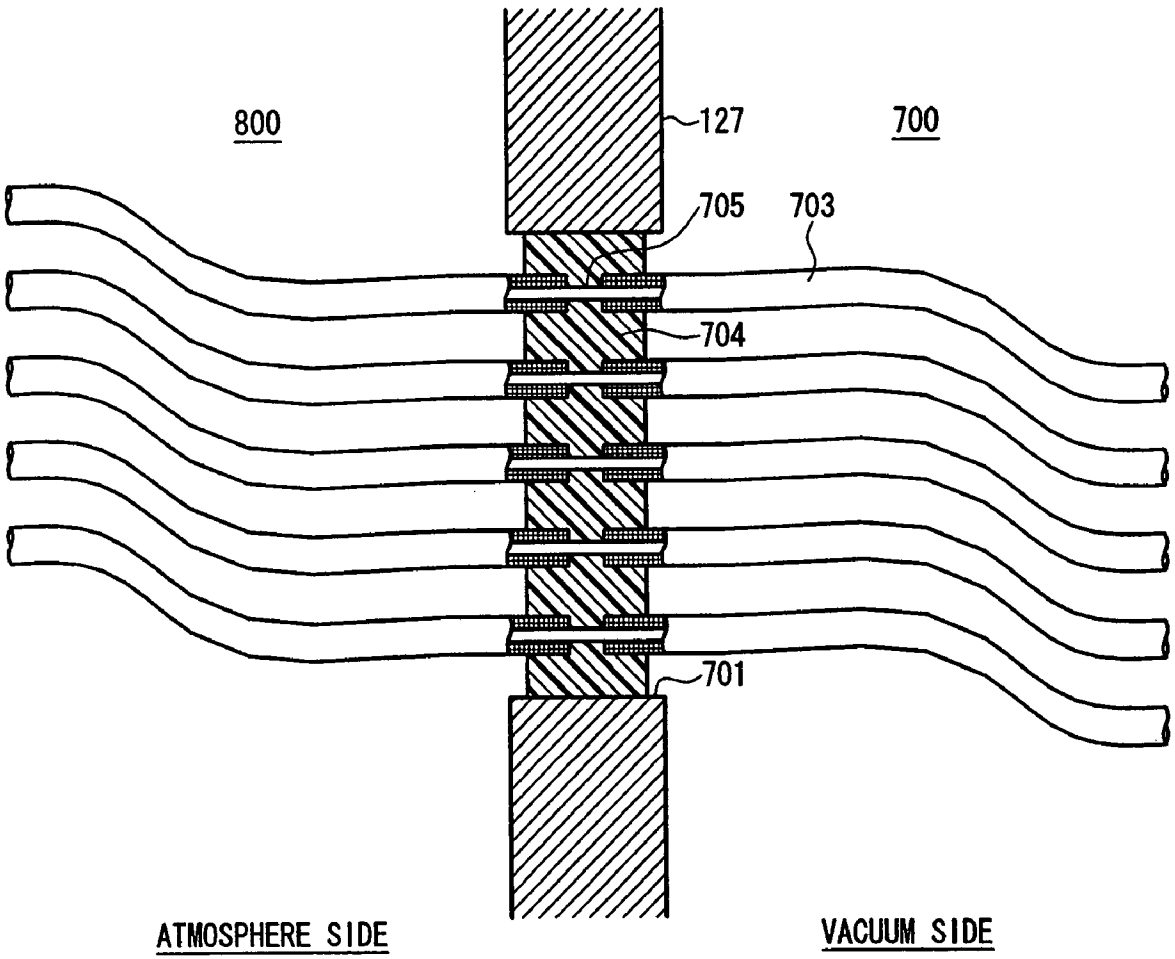
FIG. 3 is a schematic sectional view of a second embodiment of the present invention.

Next, a second embodiment of the present invention will be described. While the conventional connector structure on the pump side has both a vacuum seal function and a conductor attachment/detachment function, in the second embodiment of the present invention, the vacuum seal function and the conductor attachment/detachment function are separated from each other. FIG. 3 is a schematic sectional view of the second embodiment of the present invention. As shown in FIG. 3, an opening 701 is provided in the outer cylinder 127 of a turbo molecular pump main body 700. A control device 800 is integrated with the turbo molecular pump main body 700 through the opening 701. A plurality of cables 703 are passed through the opening 701.

In the portions of the cables 703 situated inside the opening 701, covering of the cables is partially peeled off to expose conductors 705. In this state, the cables 703 are fixed in position through molding with a resin. Further, a molding member 704 thus formed of the resin is fixed to or integrated with the opening 701. End portions of the cables 703 entering the control device 800 are connected to miniature terminals (not shown), directly connected to the board, etc. The cables 703 entering the control device 800 may be bundled for wiring, or separated into units of one to several cables to be connected to terminals. The miniature terminals may be small-sized ones as currently used in personal computers or the like, and constructed so as to be mounted to a board.

With this construction, the cables 703 are molded with a resin with the conductors 705 exposed, so it is possible to prevent the gas leakage through gaps between the conductors and the cable covering. As a result, it is possible to effect a vacuum seal without using a large vacuum connector. Thus, it is possible to realize a space saving and a reduction in cost. Further, the pump and the control circuit are connected to each other by the cables 703, so even if an excessive force is applied, the cables simply deflect, and there is no fear of the connectors suffering damage. Thus, there is little fear of a gas leakage occurring from the turbo molecular pump main body 300 to cause a pump heating, an electrical short-circuiting, a leakage of current, etc., thereby achieving an improvement in terms of the reliability of the pump.

Figure 4:
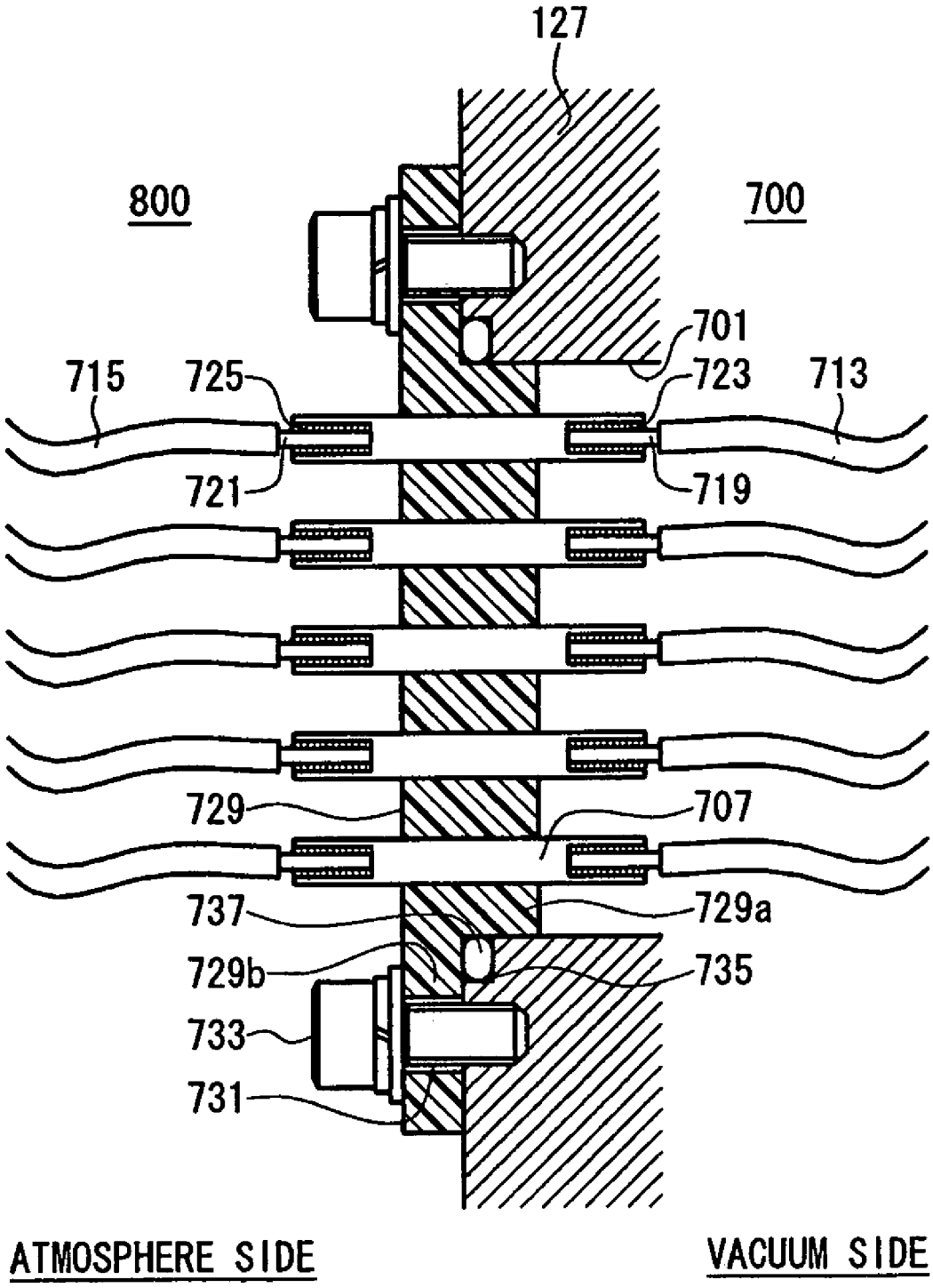
FIG. 4 is a schematic sectional view of a third embodiment of the present invention.
Figure 5:
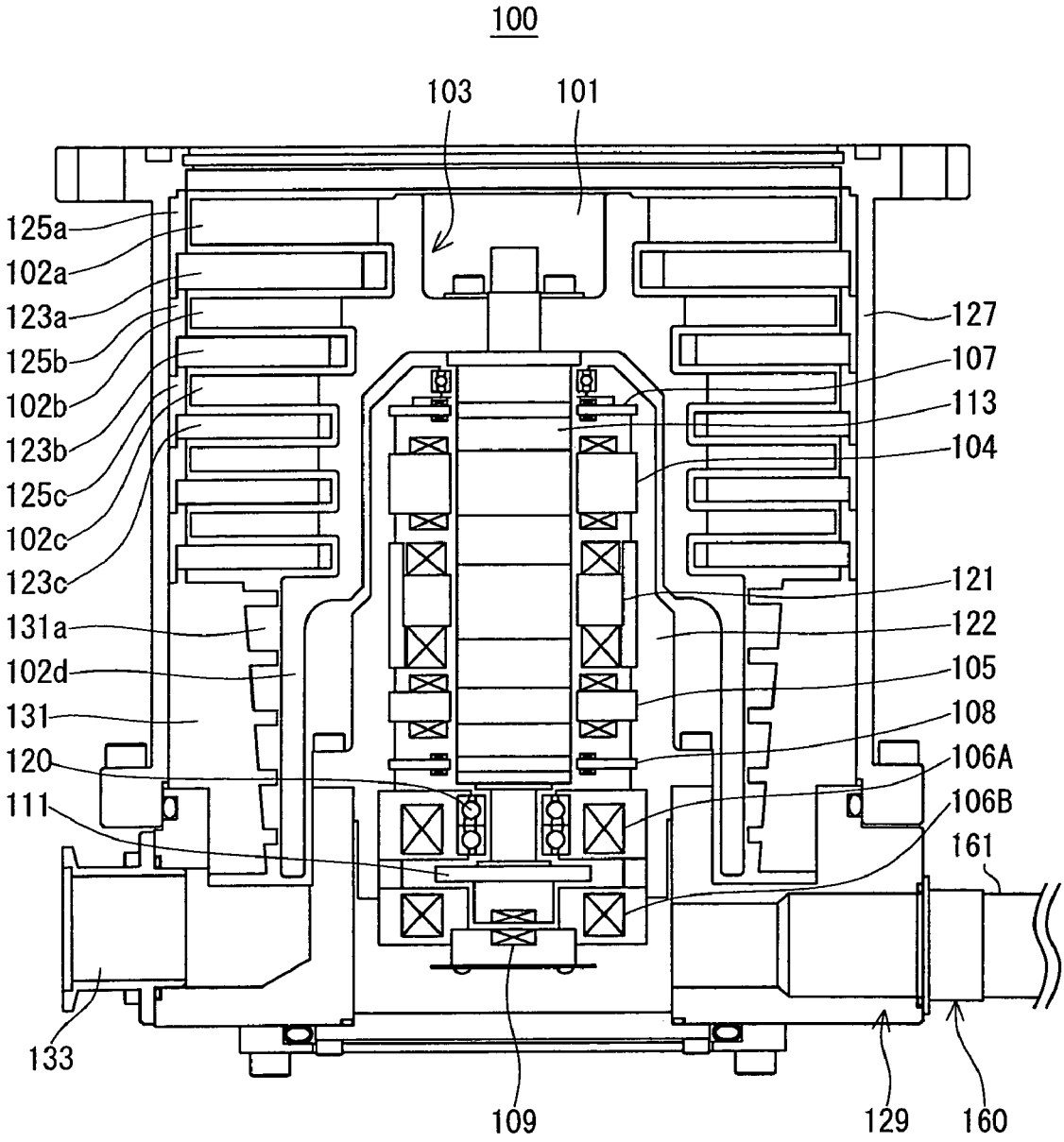
FIG. 5 PRIOR ART
FIG. 5 is a longitudinal sectional view of a turbo molecular pump main body.
Figure 6:
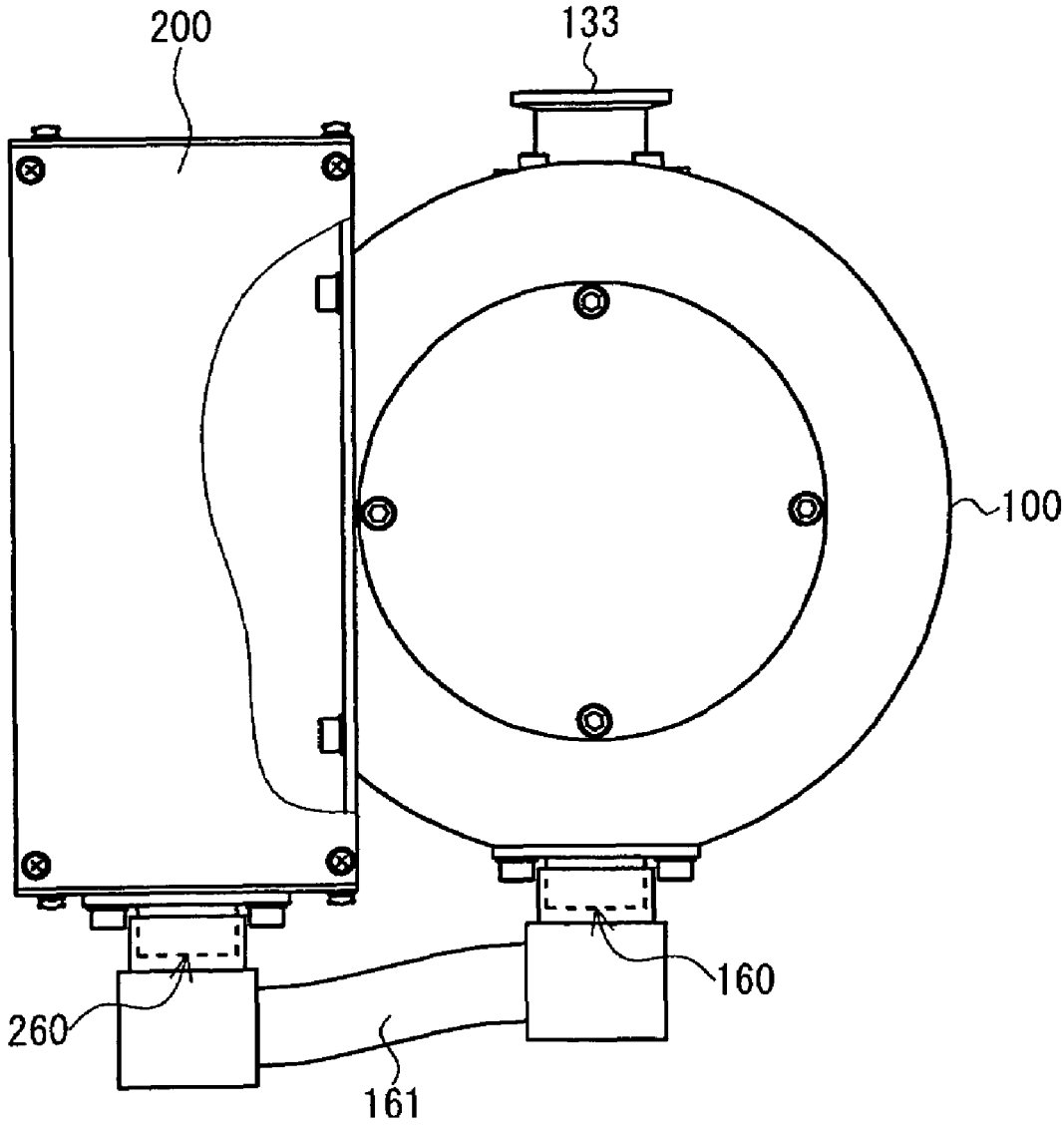
FIG. 6 PRIOR ART
FIG. 6 is a diagram showing an arrangement example in which a turbo molecular pump main body and a control device are integrated with each other.
Figure 7:
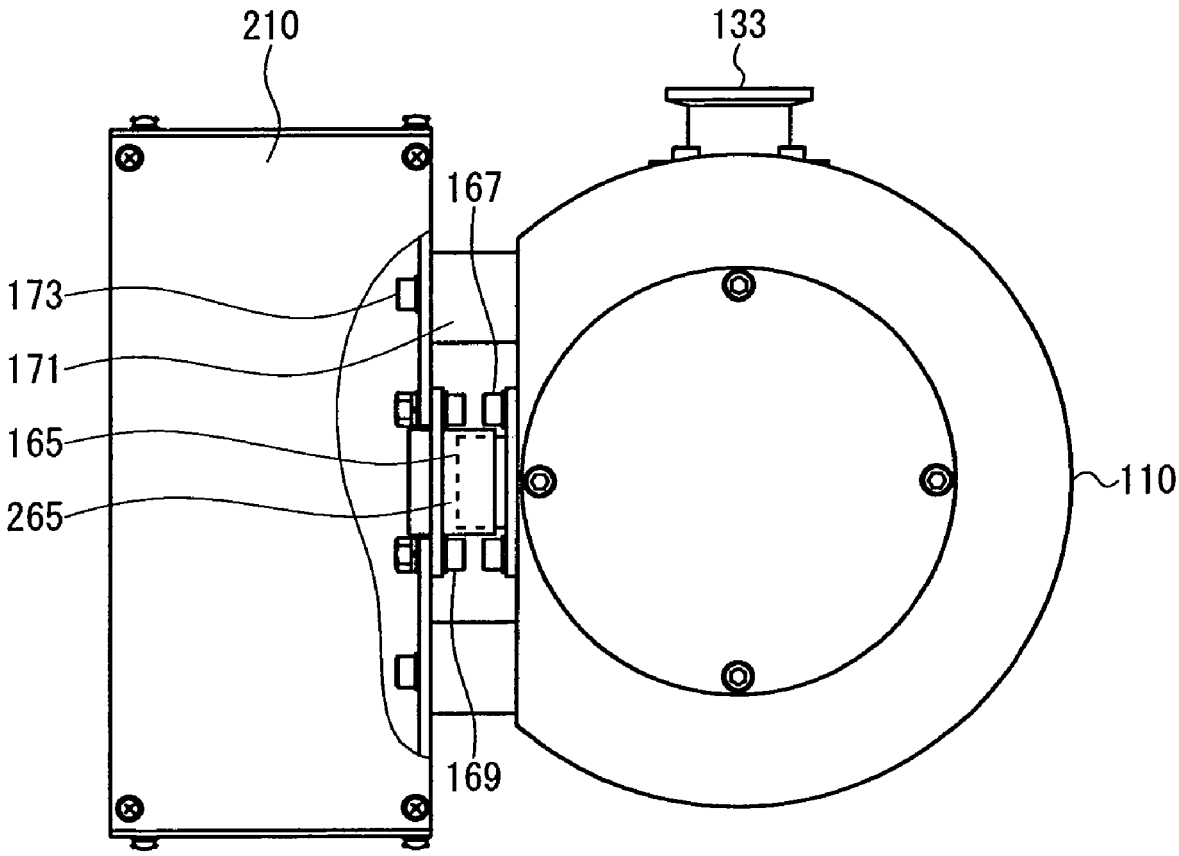
FIG. 7 PRIOR ART
FIG. 7 is a diagram showing another arrangement example in which a turbo molecular pump main body and a control device are integrated.

Next, a third embodiment of the present invention will be described. The third embodiment of the present invention is another example of the second embodiment. Also in the third embodiment of the present invention, the vacuum seal function and the conductor attachment/detachment function are separated from each other. FIG. 4 is a schematic sectional view of the third embodiment of the present invention. As shown in FIG. 4, the opening 701 is provided in a wall of the outer cylinder or pump case 127 of the turbo molecular pump main body 700. The control device 800 is integrated with the turbo molecular pump main body 700 through the opening 701. A plurality of connector of pins 707 are passed through the opening 701.

At the ends of each connector pin 707, there are formed elongated holes 723 and 725 so as to allow soldering after passing conductors or cores 719 and 721 of cables 713 and 715, respectively. A resin is solidification-molded with the connector pins 707 included. A covering member 729 thus formed through solidification-molding is composed of a protrusion portion 729*a* fit-engaged with the opening 701 and a bottom flange portion 729*b* covering the outer cylinder 127 of the turbo molecular pump main body 700. A plurality of through-holes 731 are provided in the bottom flange portion 729*b* of the covering member 729, and the covering member 729 is detachably fastened to the outer cylinder 127 of the turbo molecular pump main body 700 by bolts 733 passing through the through-holes 731. In an edge portion of the opening 701 of the outer cylinder 127 of the turbo molecular pump main body 700, there is provided a peripheral cutout 735, in which a sealing ring in the form of an O-ring 737 is disposed so as to be interposed between the bottom flange portion 729*b* and the outer cylinder 127.

With this construction, there is no gap between the covering member 729 and the connector pins 707; further, the O-ring 737 is arranged, whereby a vacuum seal is maintained. As a result, it is possible to effect a vacuum seal without using a large vacuum connector. Thus, it is possible to realize a space saving and a reduction in cost.

Further, soldering is effected after passing the cores 719 and 721 of the cables 713 and 715 through the elongated holes 723 and 725 at both the end portions of the pins 707, respectively, which means the operation involved is easy to perform. The pump and the control circuit are connected to each other by the cables 713 and 715, so even if an excessive force is applied, the cables simply deflect, and there is no fear of the connectors suffering damage. Thus, there is little fear of an electrical short-circuiting, a leakage of current, etc., thereby achieving an improvement in terms of the reliability of the pump.

The end portions of the cables 715 entering the control device 800 are connected to miniature terminals (not shown), directly connected to the board, etc. The cables 715 entering the control device 800 may be bundled for wiring, or separated into units of one to several cables to be connected to terminals.

As described above, according to the present invention, elastic retention is achieved between connectors and members retaining the connectors, so, even when an excessive force is exerted between a male connector and a female connector after one of them is inserted somewhat obliquely with respect to the other, it is possible to mitigate the force through an elastic retaining force, so there is no fear of the connectors suffering damage. Thus, there is little fear of an electrical short-circuiting, a leakage of current, etc.

What is claimed is:

1. A vacuum pump, comprising:

at least one pin with conductivity;

cable conductor fixing means arranged at both ends of the pin for allowing conductors of cables to be fixed to the pin;

a covering member formed through solidification-molding with the pin included; and an outer cylinder to which the covering member is mounted;

wherein a control device is provided side by side with the outer cylinder, wherein a cable inside the outer cylinder and a cable inside the control device are electrically connected through the covering member, and wherein the solidification-molded portion of the covering member and at least one of a bottom portion of the covering member mounted to the outer cylinder, and a protrusion fit-engaged with an opening of the outer cylinder, are formed as seals.

2. A vacuum pump comprising:

a pump casing that contains a rotor portion and a stator portion for creating a vacuum inside the pump casing and that has an opening in a wall thereof;

a control device disposed outside the pump casing for controlling operation of the vacuum pump;

a cover member detachably attached to the pump casing to cover and seal the opening, the cover member having a plurality of connector pins extending therethrough and projecting outwardly from opposite sides thereof, the cover member being formed of molded resin with the connector pins molded therein; and first flexible conductors that electrically connect the control device to respective connector pins on one side of the cover member, and second flexible conductors disposed inside the pump casing and electrically connected to respective connector pins on the other side of the cover member.

3. A vacuum pump according to claim 2; wherein the projecting ends of the connector pins each have an elongated hole that receives therein an end of one of the conductors.

4. A vacuum pump according to claim 3; further including a sealing ring interposed between the cover member and the pump casing and surrounding the opening.

5. A vacuum pump according to claim 4; wherein the cover member has a protrusion portion engaged in the opening, and a flange portion surrounding the protrusion portion and detachably attached to the pump casing.

6. A vacuum pump according to claim 5; wherein the sealing ring is interposed between the flange portion and the pump casing.

7. A vacuum pump according to claim 2; wherein the cover member has a protrusion portion engaged in the opening, and a flange portion surrounding the protrusion portion and detachably attached to the pump casing.

8. A vacuum pump according to claim 7; further including a sealing ring interposed between the flange portion and the pump casing and surrounding the opening.

* * * * *